US005419459A

United States Patent [19]

O'Meara

[11] Patent Number: 5,419,459

[45] Date of Patent: May 30, 1995

[54] CHILD RESISTANT MEDICAMENT DISPENSER

[75] Inventor: John R. O'Meara, Jamesburg, N.J.

[73] Assignee: CP Packaging, Inc., Jamesburg, N.J.

[21] Appl. No.: 185,401

[22] Filed: Jan. 24, 1994

Related U.S. Application Data

[62] Division of Ser. No. 830,308, Jan. 31, 1992, Pat. No. 5,301,837.

[51] Int. Cl.[6] ..... B67D 5/00

[52] U.S. Cl. ..... 222/83; 222/541

[58] Field of Search ..... 222/81, 83, 153, 519, 222/522, 541; 220/258, 277, 278; 215/206, 226, 250

[56] References Cited

U.S. PATENT DOCUMENTS

| | | | |
|---|---|---|---|
| 1,909,209 | 5/1933 | Miller | 222/81 |
| 2,365,524 | 12/1944 | Court | 222/81 |
| 4,346,820 | 8/1982 | Cavazza | 222/83 |
| 4,867,326 | 9/1989 | O'Meara | 222/83 |
| 5,301,837 | 4/1994 | O'Meara | 222/83 |

FOREIGN PATENT DOCUMENTS

| | | | |
|---|---|---|---|
| 9112198 | 8/1991 | WIPO | 222/83 |

*Primary Examiner*—Andres Kashnikow

*Assistant Examiner*—Philippe Derakshani

*Attorney, Agent, or Firm*—Eugene E. Renz, Jr.

[57] ABSTRACT

A child resistant cap and tube assembly including a tube for containing a product and having an end portion with a recessed thin wall section puncturable to provide a discharge opening and a shoulder for limiting axial movement on the end portion. The cap has a central axis for alignment with the tube to slidably engage it. A piercer is normally spaced from the thin wall section in a first position and operable to puncture the thin wall upon movement of the cap to a second position. On the cap is formed a shoulder engaging portion for preventing movement to the second position without it being intentionally manipulated to a shoulder disengaging position. This portion may comprise a skirt detatchably attached to the end of the cap to prevent movement of the cap to the second position until the skirt is removed. Alternatively, this portion may comprise a ring and groove with the piercer being located on the other end of the cap whereby the intentional manipulation includes disengagement of the ring and groove. In still another alternative, the portion comprises a boss and socket, the socket being normally out of alignment with the boss and the intentional manipulation includes aligning the boss and socket.

1 Claim, 4 Drawing Sheets

FIG. 11
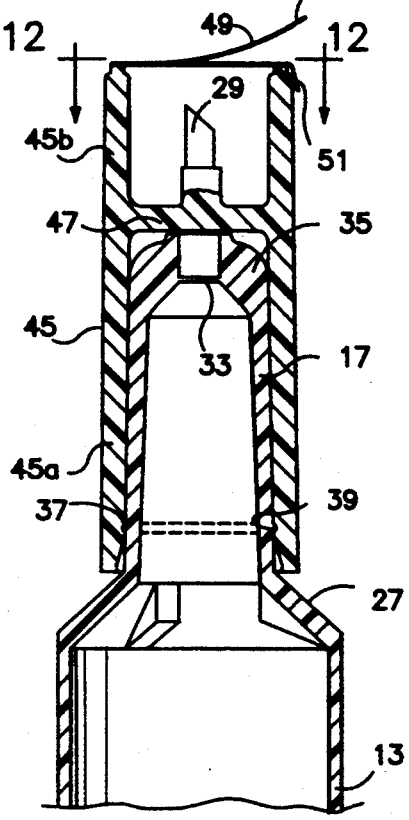
FIG. 12
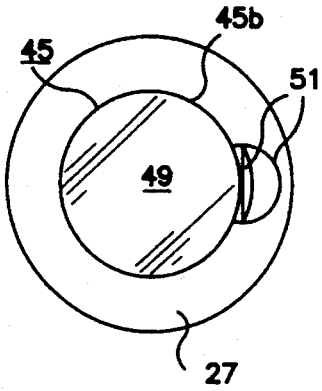
FIG. 13
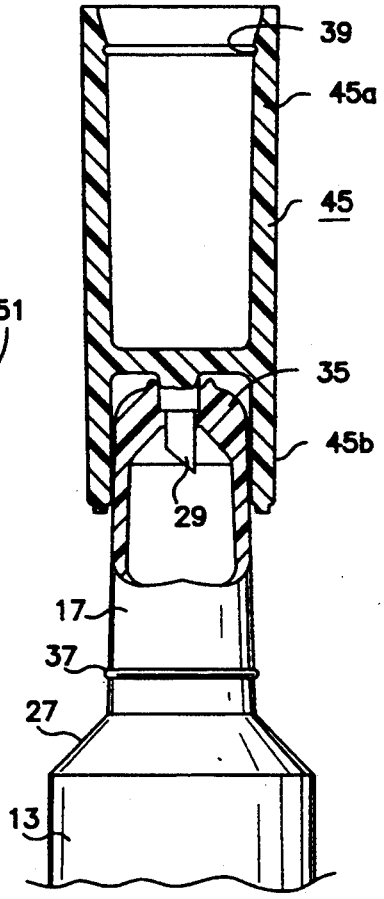
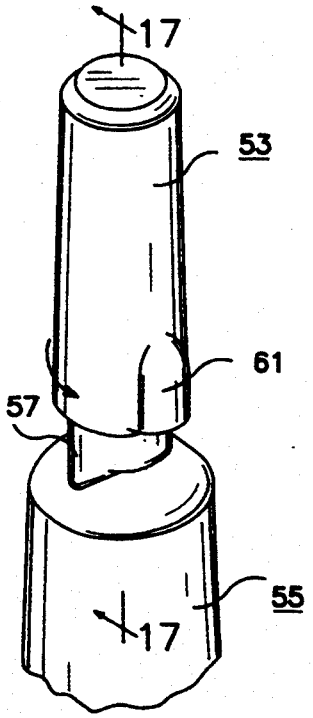
FIG. 14
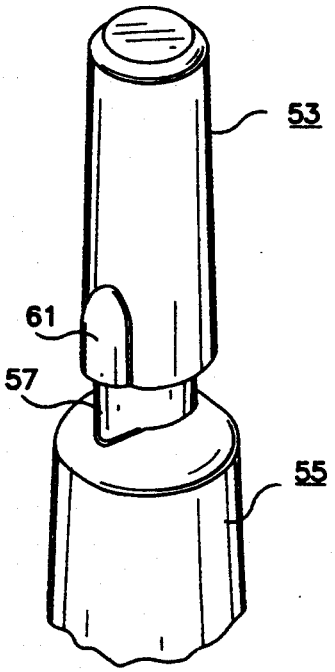
FIG. 15
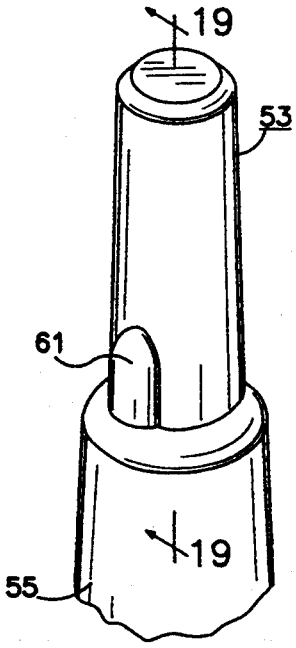
FIG. 16

CHILD RESISTANT MEDICAMENT DISPENSER

This is a continuation of application Ser. No. 07/830,308, filed on Jan. 31, 1992, now U.S. Pat. No. 5,301,837.

FIELD OF THE INVENTION

The present invention relates to a device for containing and dispensing medicaments and other contents, and more particularly to a device in which the requirements for providing access to the contents are such that children and others not skilled in the use of the invention will have difficulty in obtaining access to the contents. In its simplest form, the invention relates to child resistant features which protect the child from unauthorized access to the container contents.

BACKGROUND OF THE INVENTION

The field of child resistant cap and tube assemblies, which carry medicines, vitamins and the like, have become of major importance and interest in the pharmaceutical industry. I is a growing need that container assemblies be difficult for children to open, particularly accidentally. Also, increased interest is being shown in cap and tube assemblies which cannot be opened by happenstance but which require a specific and positive step to be taken in order to have access to the contents. This is particularly true when medicines, vitamins and topical treatments such as eye drops are contained in such tubes.

In prior art devices, designs have been proposed which include a three piece construction where a tube body contains a plug attached to a portion of the main body of the tube. The wall of the tube has been weakened sufficiently to permit the plug to be torn from the tube. A cap portion is designed so that one end might be fitted over the tube having the plug, thereby protecting the plug and tube. The other end is then designed to interact with the plug in a twisting manner to remove the plug by rupturing the thin wall of the tube to which the plug is attached. This design has not been effective, however, because of the additional concern caused by the existence of the plug and the need for safe and reliable disposal of the plug.

In my prior U.S. Pat. No. 4,867,326, I have developed a child-resistant cap and tube assembly which has a high reliability in pass/fail inspection opportunities. This design permits easy inspection of unit close sterile medicaments which do not contain preservatives in the product, to avoid use of spoiled or contaminated products.

My prior device has a tube which has one end portion which terminates in an axially centered first opened surface at the outer perimeter of the end portion. Recessed below the surface of the end portion is a thin wall which seals the tube. The tube has a second surface, called a surface of interference, which operates to interfere with axial movement on the end portion. The cap has a resistance surface which interengages the end to locate the cap at a first position where a thin wall portion on the tube is protected. Movement overcoming the restraining efforts of the two surfaces causes a puncture means to move to then puncture the thin wall and provide access to the contents.

One of the difficulties with the prior device in my U.S. Pat. No. 4,867,326 is not that it is not effective. Rather, it has been highly effective In keeping children and others from inadvertently opening the container and causing loss or damage to the contents. It is also suitable for a pass/fail inspection step as the thin wall is clearly visible when the cap is removed. If it appears to have been punctured, the contents or the condition of the thin wall will make that fact easily determined.

One of the features of my prior U.S. Pat. No. 4,867,326 is that the package looks substantially the same before and after activation. This is an appealing appearance but is not suitable in those situations when it is necessary to determine whether or not there has been activation by the mere glance of the eye. In other words, It is not possible to tell at a glance if the child-resistant feature has been overcome in some manner. Accordingly, It is an object of this invention to provide a device which is capable of providing not only child-resistance but also a quick visual warning or sign that the device has In fact been opened.

As is true In any system where axial force is the primary direction in which a system operates, there is another way in which my system described In my U.S. Pat. No. 4,867,326 can be improved. In my prior system, axial activation force was all that was needed to overcome, abeit with substantial force, the interengagement of the resistance surface and the surface of interference. Once this takes place, for whatever reason, the piercer moves to the second position as described in that patent and the thin wall seal which has been protecting the contents is pierced. That is desirable only when the user makes that decision and not merely because the force has been overcome inadvertently. It is therefore another object of this invention to provide a child-resistant tube and cap assembly that requires more than axial force to provide access to the contents. At the same time, it is an object of this invention to provide a device which retains the simple and very effective axial activation system of my U.S. Pat. No. 4,867,326. Thus it is an object of this invention to have the best of my prior design while adding additional features of value.

There is another concern that has become important in the child-resistant container industry, and that is the desire that a conscious mental step be needed In order to move the cap and tube Into alignment for activation, and that they are somehow not capable of activation without that conscious step. Stated another way, It is an object of this invention to provide a device which is sufficiently complex to prevent random activity from putting the device In a condition for being activated.

Other objects will appear hereinafter.

SUMMARY OF THE INVENTION

It has now been discovered that the above and other objects of present invention may be accomplished in the following manner. Specifically, a new child resistant cap and tube assembly has been discovered. This assembly includes a tube for containing a product, which tube has an end portion with a recessed thin wall section which is designed to be puncturable to provide a discharge opening for the contents of the tube. There is also provided a shoulder element or portion of the tube which serves to limit axial movement of a cap on the end portion of the tube.

The assembly also includes a cap having a central axis for alignment with the tube. It is sized to slidably engage the end portion of the tube. The cap also has an axially centered puncture means or piercer which is positioned to be aligned with the thin wall section of the tube. The piercer is normally spaced from the thin wall section In a first position which is spaced from the thin wall and where the thin wall is protected from being punctured. The piercer is operable to puncture said thin wall upon movement of the cap to a second position, after which it can be removed so that the contents can be discharged for use.

The cap also has a shoulder engaging part which is used to prevent axial movement of the cap from the first position to said second position without intentional manipulation of this shoulder engaging part to a shoulder disengaging position. There are several embodiments of this portion of the assembly, each of which prevent movement of the cap to the second position and engagement of the piercer and the thin wall is protected and prevented. Once the intentional manipulation is performed, movement to the second position and puncture of the thin wall is easy to accomplish.

In one embodiment, the shoulder is formed by the terminal end of the tube on which the end portion is placed. In this embodiment, the shoulder engaging means comprises a skirt which is detatchably attached to the tube engaging end of the cap. The skirt thus engages the shoulder to prevent movement of the cap to the second position until the skirt is removed. One form of this embodiment includes a skirt which is a tear-off skirt that has been frangibly attached to the cap, such as by scoring or the like. The tear-off skirt is adapted to be removed by intentional manipulation, simply by tearing the skirt from the assembly and placing the removed portion In an appropriate disposal container. Alternatively, the skirt may be a split skirt having a frangible seam which is adapted to be split by said intentional manipulation, in this case simply by pushing on the end of the cap.

A preferred embodiment includes the use of a ring and groove, one of each being on the end portion and on the one end of said cap to define the first position upon engagement of the groove and ring. The ring and groove are sized to engage each other with sufficient three to prevent accidental movement of the cap toward the thin wall portion. In this embodiment, the axially centered puncture means is preferably located on the other end of said cap whereby the intentional manipulation includes disengagement of the ring and groove and slideable movement of the other end of the cap to the second position. For sanitary reasons this embodiment includes closure ,means such as tear-off tape for covering the end of the cap having the axially centered puncture means. Thus, the intentional manipulation also includes removal of the tear-off tape or other closure means prior to movement of the cap to the second position.

In yet another preferred embodiment, the shoulder comprises a boss means located on the end portion of the tube and the shoulder engaging means comprises socket means on the cap. The socket means is normally out of alignment with the boss means and in this manner defines the first position where the piercer is safely spaced from the thin wall of the tube. The intentional manipulation includes aligning the boss means and the socket means to permit movement of the cap to the second position. Once the boss and socket aligned, there is nothing preventing slideable movement of the piercer through the thin wall of the tube. In this embodiment, the socket should extend radially from the cap at one location on the cap, both to indicate the location and to provide purchase for the twisting movement of the cap on the tube end which will be necessary to align the boss and socket. Also to provide visual location of the boss, the boss extends below the cap when the cap is in the first position.

In this way, the user is able to visually observe the location of both the socket means and the boss means so as to easily make the appropriate alignment and to recognize cap and tube assemblies which have been activated previously. In this manner, this embodiment provides as a tamper evident feature. Similarly, the design which includes a detatchable skirt very clearly provides a tamper evident feature. Likewise, the ring and groove embodiment has a tamper evident feature with the removable tear-off tape or other closure, as well with the cap having to be removed and the other end attached to the tube.

BRIEF DESCRIPTION OF THE DRAWINGS

For a more complete understanding of the invention, reference is hereby made to the drawings, in which:

FIG. 11 is an enlarged, fragmentary, sectional elevational view of another embodiment which is different from the embodiment shown in FIG. 1, again illustrating details of construction and assembly.

FIG. 12 is a plan view taken on the line 12,12 of FIG. 11.

FIG. 13 is an enlarged, fragmentary, sectional elevational view of the embodiment shown in FIG. 11, In an activation mode.

FIGS. 14–16 are sequential isometric views illustrating the method of use of another embodiment of the invention shown in FIG. 1, showing the steps needed in order to release the medicament contained within the sealed tube.

DETAILED DESCRIPTION OF THE PREFERRED EMBODIMENT

Figure 4:
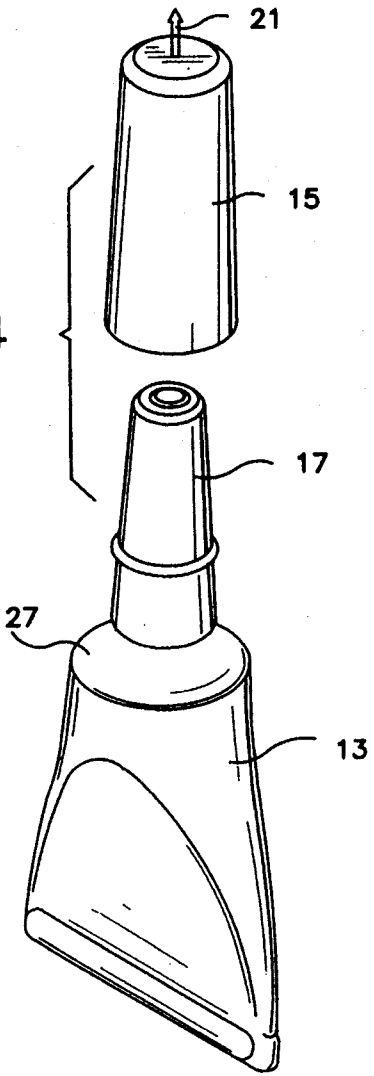
FIGS. 2–4 are sequential isometric views illustrating the method of use of the present invention in order to release the medicament contained within the sealed tube.
Figure 3:
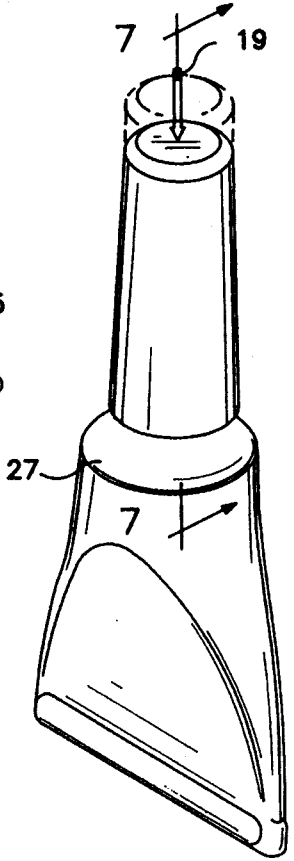

As is noted in the drawings, the assembly of this invention is shown generally by the reference number 10. The assembly includes a tube 13 and cap 15 which is positioned on the discharge or terminal end portion 17 of tube 13. Movement of the cap 15 in the direction of the arrow 19, as shown in FIG. 3, engages a part of the device, described herein below, which provides access to the contents of the tube 13. Movement of cap 15 in the direction of arrow 2 1 in FIG. 4 removes the cap 15 and allows the contents of the tube to be dispensed. Typically, vitamins, eye drops, and unit dose medicaments are contained in tube and cap assemblies of this type.

Figure 2:
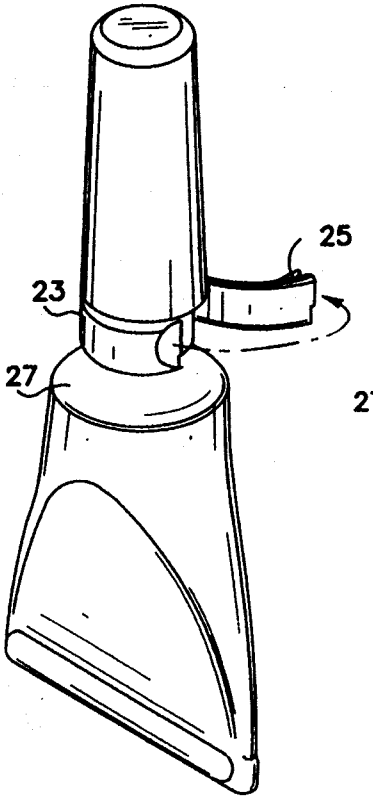
Figure 1:
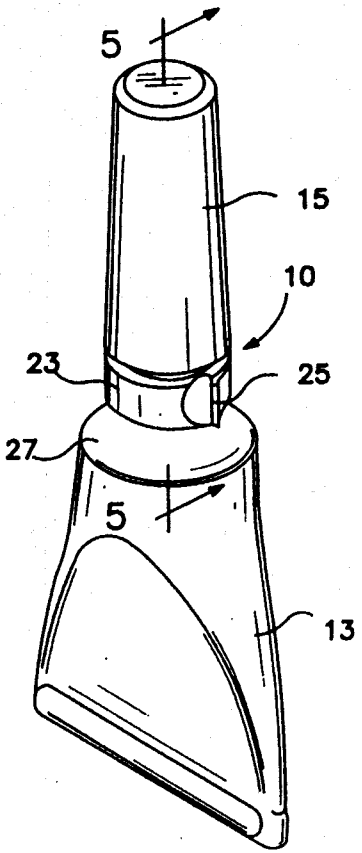
FIG. 1 is an isometric view of a child resistant and tamper evident pierce-pak container, all in accordance with the invention.

Access to the contents in the tube of the present invention is restricted by the assembly of the present invention, requiring an intentional manipulation of a portion of the assembly before access to the contents can be obtained. In FIG. 1, a skirt 23 having a pull tab 25 is located on the tube engaging end of cap 15. This skirt 23 rests on shoulder 27 of tube 13 so that further movement of the cap, such as in the direction of arrow 19 is not possible as long as skirt 23 is still on the cap. Intentional manipulation to remove the skirt 23 by pulling pull tab 25, as illustrated in FIG. 2, places the assembly in a ready to use condition.

Figure 5:
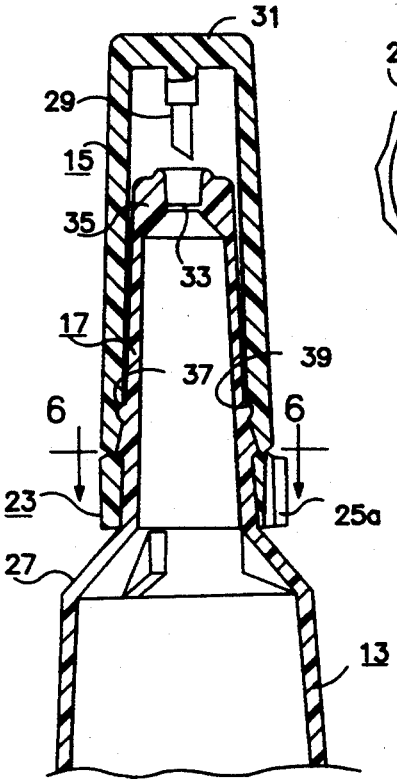
FIG. 5 is an enlarged, fragmentary, sectional elevational view taken along the line 5,5 of FIG. 1, illustrating details of construction and assembly.
Figure 6:
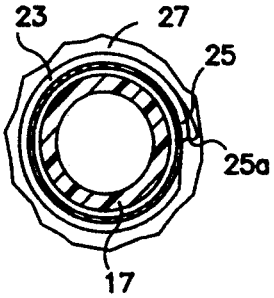
FIG. 6 is a fragmentary, sectional elevational view taken on the line 6,6 of FIG. 5, illustrating additional details of the tear-off skirt.
Figure 7:
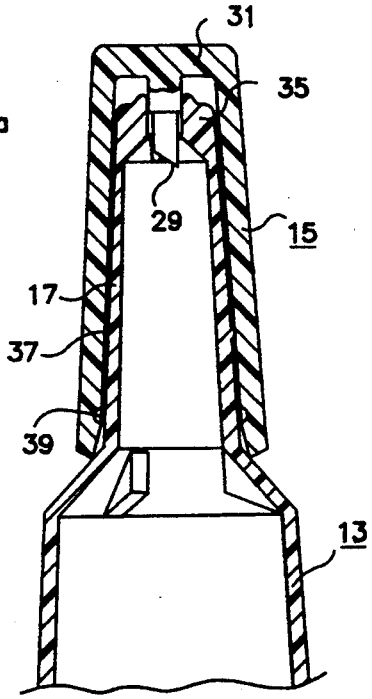
FIG. 7 is an enlarged, fragmentary, sectional elevational view taken along the line 7,7 of FIG. 3.

Turning now to FIGS. 5, 6 and 7, the internal working of the assembly can be seen. In FIG. 5, the device is as shown in FIG. 1 and the skirt 23 abuts shoulder 27 to prevent movement of the cap 15 in the tube engaging direction. The edge **25*a* of pull tab 25 is accessible and the pull tab 25 can be removed easily. This intentional manipulation is necessary for use of the tube. Piercer 29 is mounted on the inside of end wall 31 of cap 15, and is held in a first position as illustrated in FIG. 5. As long as skirt 23 is present, piercer 29 cannot contact thin wall section 33 of tip 35 of tube end portion 17**.

Also shown on the assembly illustrated in FIG. 5 is a ring 37 and groove 39 which serves as a secondary restraint to prevent unintentional movement of the cap toward the tube. As shown in FIG. 7, the puncture means or piercer 29 is able to penetrate thin wall section 33, allowing for access to the contents after the cap 15 is removed from the tube end portion 17.

Figure 8:
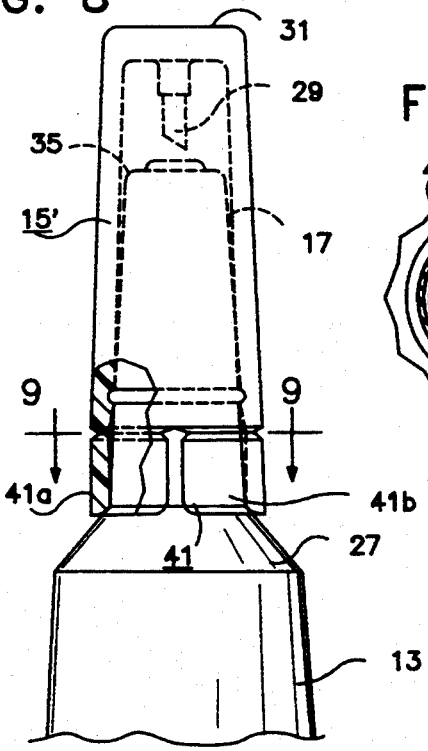
FIG. 8 is an enlarged, fragmentary, elevational view with a portion broken away and in section, showing another embodiment of the invention.
Figure 9:
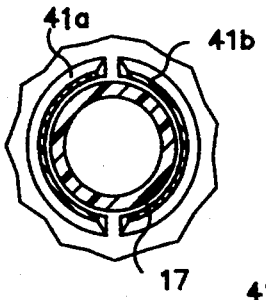
FIG. 9 is a fragmentary sectional, plan view taken on the line 9,9 of FIG. 8.
Figure 10:
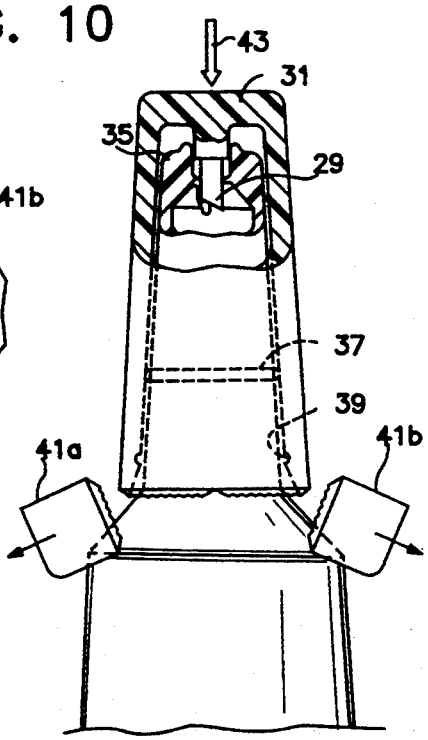
FIG. 10 is a fragmentary, elevational view of the embodiment of FIG. 8, with a portion broken away and in section.

A similar assembly is shown in FIGS. 8, 9 and 10, in which a modification of the skirt previously described is shown. Split skirt 41 restrains movement of cap 15' toward tube 13 because it cannot move past shoulder 27. In this embodiment, intentional manipulation of the assembly to open the tube requires that the cap 15' be pushed axially toward the tube 13 so that split skirt 41 impinges on shoulder 27 in the direction of arrow 43. If sufficient pressure is applied, split skirt 41 splits along a frangible portion, such as produced by score lines, and breaks into two portions **41*a* and 41*b*. Once the skirt 41 has split, cap 15' can be moved to cause piercer 29 to puncture thin wall section 33** as previously described.

Turning now to FIGS. 11, 12 and 13, another assembly according to the present invention is shown. This assembly includes a modified cap 45 which has a first end **45*a* and second end 45*b* separated by dividing wall 47. Piercer 29 is mounted on dividing wall 47 and is facing away from thin wall section 33 of end 35 of tube end portion 17. Piercer 29 is sterilized and kept sanitary by a closure member, shown in FIG. 11 in the form of tear-off tape 49. Tear-off tape 49 seals the end 45*b* of cap 45 and can be removed when needed by pulling tab 51 on tear-off tape 49**.

The cap 45, which has been held in place by ring 37 and groove 39, is removed from tube end portion 17, the cap 45 is inverted, the tear-off tape 49 is removed by pulling tab 51, and the end **45*b* of cap 45 is placed in a second position, shown in FIG. 13, where piercer 29 once again punctures thin wall section 33** to provide access to the tube contents.

A preferred embodiment is shown in FIGS. 14–20. In this embodiment, the cap 53 is prevented from moving toward tube 55 by a boss 57 which is part of tube end portion 59. The lower terminal end **53*a* of cap 53 can not move past boss 57, and thus the cap 53 is maintained in its first position, where access to the contents is prevented. Intentional manipulation of cap 53 to bring socket 61 into alignment with boss 57, as illustrated in FIG. 15 allows cap to slide on tube end portion 59 to a second position shown in FIG. 19**.

Figure 17:
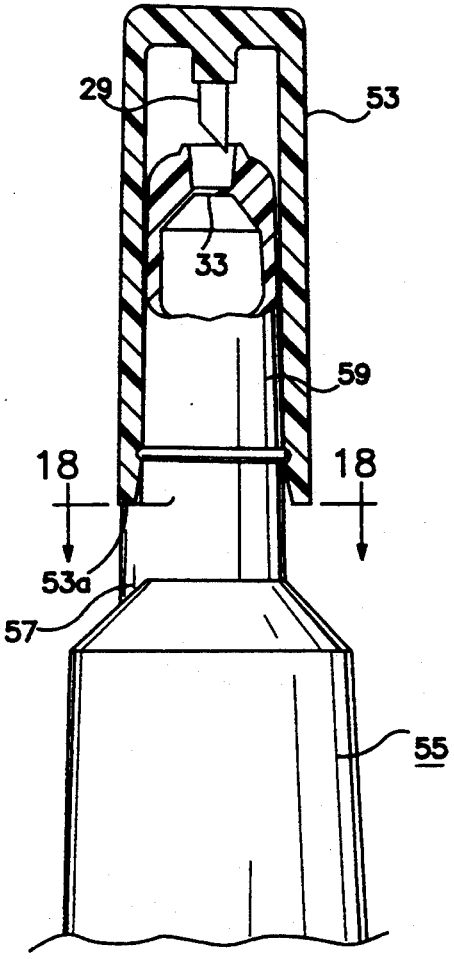
FIG. 17 is an enlarged, fragmentary, sectional elevational view taken along line 17, 17 of FIG. 14 illustrating details of construction and assembly.
Figure 19:
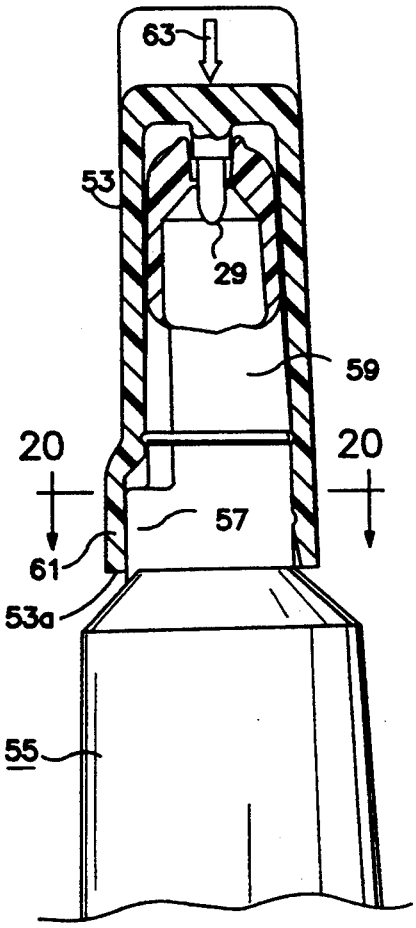
FIG. 19 is an enlarged, fragmentary, sectional elevational view of the embodiment shown in FIG. 17, in an activation mode.
Figure 18:
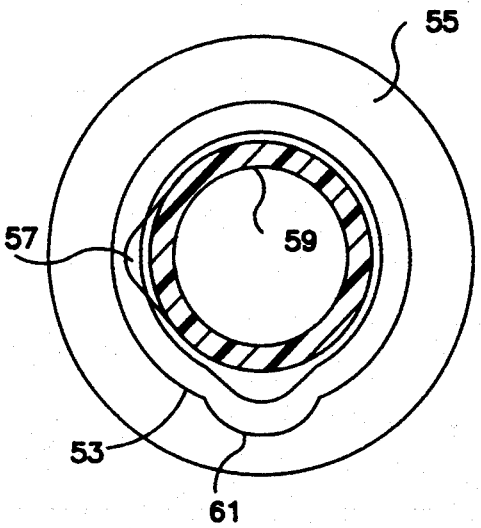
FIG. 18 is an enlarged, sectional, plan view taken on the line 18, 18 of FIG. 17.
Figure 20:
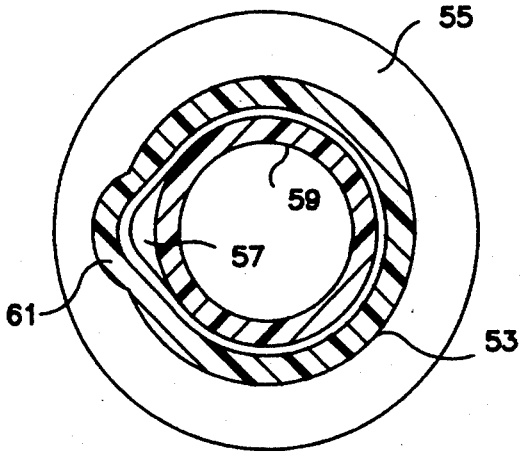
FIG. 20 is a sectional, plan view taken on the line 20,20 of FIG. 19.

When the lower terminal end 53a of cap 53 is in contact with boss 57, as shown in FIG. 17, the cap 53 is held in a first position where piercer 29 is spaced from thin wall section 33. Rotation of cap 53 to align boss 57 and socket 61, as shown in FIGS. 19 and 20, allows cap 53 to be pushed in the direction of arrow 63 to provide access to the the tube contents. Without the intentional manipulation of the cap 53 from the safe position of FIG. 17 to the ready position of FIG. 19, the assembly is at least child resistant. Casual playing is not likely to cause the needed alignment. When such alignment is desired, pressure on boss 57 and the outside of socket 61 allows the two components to be rotated with respect to each other to achieve a ready to use condition.

In each of the embodiments shown herein, it is necessary to move the cap from a first position with a puncture means spaced from the thin wall section of the end portion of the tube to a second position to permit puncture of the thin wall section. This required or necessary movement of the cap with respect to the tube must be made using Intentional manipulation of the assembly. This substantially reduces accidental access to the tube and greatly increases the safety and security of the product being sold.

While particular embodiments of the present invention have been illustrated and described, it is not intended to limit the invention, except as defined by the following claims.

I claim:

1. A child resistant cap and tube assembly, comprising:

a tube for containing a product and having an end portion with a recessed thin wall section puncturable to provide a discharge opening and a shoulder means for limiting axial movement on said end portion;

a cap having a central axis for alignment with said tube and sized to slidably engage said end portion;

an axially centered puncture means positioned to be aligned with said thin wall section and normally spaced from said thin wall section in a first position and operable to puncture said thin wall upon movement of said cap to a second position for opening said discharge opening;

means defining circumferentially spaced axially extending slits extending inwardly from the lower edge of said cap; and means defining scoring in said cap spaced upwardly from the lower terminal edge thereof to define break away band portions which fracture along the scoring when the cap is actuated downwardly to engage the lower terminal edge of the band portion against the shoulder means thereby effecting separation of said break-away band portion defined by said scoring.

* * * * *

UNITED STATES PATENT AND TRADEMARK OFFICE

CERTIFICATE OF CORRECTION

PATENT NO. : 5,419,459

DATED : May 30, 1995

INVENTOR(S) : John R. O'Meara

It is certified that error appears in the above-indentified patent and that said Letters Patent is hereby corrected as shown below:

In the Abstract, line 13, please correct the spelling of "detatchably" to --detachably--.

In column 2, line 17, please correct "In" to read --in--.

In column 2, line 18, please correct "In" to read --in--.

In column 2, line 23, please correct "abeit" to read --albeit--. by applicant.

In column 3, line 20, please correct "detatchably" to read --detachably--.

In column 3, line 39, please correct the word "three" to read --force--.

UNITED STATES PATENT AND TRADEMARK OFFICE

CERTIFICATE OF CORRECTION

PATENT NO. : 5,419,459

DATED : May 30, 1995

INVENTOR(S) : John R. O'Meara

It is certified that error appears in the above-indentified patent and that said Letters Patent is hereby corrected as shown below:

In column 4, line 9, please correct "detatchable" to read --detachable--.

In column 6, lines 8 and 9, please correct "can not" to read --cannot--.

In column 6, line 21, the phrase "access to the the" should read --access to the--therefor.

Signed and Sealed this

Sixteenth Day of April, 1996

Bruce Lehman

*Attest:*

BRUCE LEHMAN

*Attesting Officer*

*Commissioner of Patents and Trademarks*